US010065386B2

(12) United States Patent
Kohno

(10) Patent No.: US 10,065,386 B2
(45) Date of Patent: Sep. 4, 2018

(54) SLIDE MOTION CONTROL APPARATUS FOR MECHANICAL PRESS

(71) Applicant: AIDA ENGINEERING, LTD., Kanagawa (JP)

(72) Inventor: Yasuyuki Kohno, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 0 days.

(21) Appl. No.: 15/496,829

(22) Filed: Apr. 25, 2017

(65) Prior Publication Data

US 2017/0225422 A1 Aug. 10, 2017

Related U.S. Application Data

(62) Division of application No. 13/861,894, filed on Apr. 12, 2013, now Pat. No. 9,815,251.

(30) Foreign Application Priority Data

Apr. 13, 2012 (JP) ..... 2012-091849
Jan. 24, 2013 (JP) ..... 2013-011044

(51) Int. Cl.
*B30B 15/14* (2006.01)
*B30B 1/24* (2006.01)
(Continued)

(52) U.S. Cl.
CPC ..... *B30B 15/148* (2013.01); *B30B 1/181* (2013.01); *B30B 1/24* (2013.01); *B30B 1/265* (2013.01); *B30B 15/14* (2013.01); *B30B 15/24* (2013.01)

(58) Field of Classification Search
CPC ..... B30B 1/18; B30B 1/181; B30B 1/186; B30B 1/23; B30B 1/24; B30B 1/265;
(Continued)

(56) References Cited

U.S. PATENT DOCUMENTS 4,881,399 A * 11/1989 Bocharov ..... B21J 9/18 100/289
5,375,513 A * 12/1994 Michael ..... B21D 35/00 100/207
(Continued)

FOREIGN PATENT DOCUMENTS

CN 101115613 A 1/2008
DE 202007007144 U1 9/2007
(Continued)

OTHER PUBLICATIONS

Office Action issued in corresponding Taiwanese Patent Application No. 102113139, dated Jul. 28, 2017 with English Translation.
(Continued)

*Primary Examiner* — Jimmy T Nguyen
(74) *Attorney, Agent, or Firm* — McDermott Will & Emery LLP

(57) ABSTRACT

A slide motion control apparatus for a mechanical press comprising: a slide which is disposed so as to be relatively vertically movable with respect to a driven body to which a drive force is transmitted through a con rod of the mechanical press; a relative position commander that outputs a relative position command indicating a relative position of the slide with respect to the driven body; a relative position detector that detects a relative position of the slide with respect to the driven body, and outputs a relative position detecting signal indicating the detected relative position; a servomotor; a drive mechanism that relatively moves the slide with respect to the driven body by a drive force of the servomotor; and a controller that controls the servomotor based on a relative position command signal output from the relative position commander, and the relative position detecting signal output from the relative position detector.

1 Claim, 16 Drawing Sheets

(51) Int. Cl.
*B30B 1/18* (2006.01)
*B30B 1/26* (2006.01)
*B30B 15/24* (2006.01)

(58) Field of Classification Search
CPC B30B 1/32; B30B 15/00; B30B 15/14; B30B 15/148; B30B 15/16; B30B 15/22; B30B 15/24
USPC ..... 100/43, 49, 269.01, 269.14, 273, 287, 100/289
See application file for complete search history.

(56) References Cited

U.S. PATENT DOCUMENTS

| | | | | |
|---|---|---|---|---|
| 6,085,520 | A | 7/2000 | Kohno | |
| 6,520,075 | B1 * | 2/2003 | Shinoda | B30B 15/24 100/214 |
| 6,647,870 | B2 | 11/2003 | Kohno | |
| 6,792,788 | B2 | 9/2004 | Futamura et al. | |
| 7,401,548 | B2 | 7/2008 | Kohno et al. | |
| 2010/0307349 | A1 | 12/2010 | Martin et al. | |

FOREIGN PATENT DOCUMENTS

| | | | |
|---|---|---|---|
| EP | 1275492 | A1 | 1/2003 |
| EP | 1693183 | A1 | 8/2006 |
| JP | 1-241400 | A | 9/1989 |
| JP | 11-226798 | A | 8/1999 |
| JP | 2001-062597 | A | 3/2001 |
| JP | 2002-219600 | A | 8/2002 |
| JP | 2003305599 | A | 10/2003 |
| JP | 2008260042 | A | 10/2008 |
| JP | 2011-502793 | A | 1/2011 |
| JP | 2011-194466 | A | 10/2011 |
| TW | 200630211 | A | 9/2006 |

OTHER PUBLICATIONS

First Office Acton issued in Chinese Patent Application No. 201310124435.2 dated Aug. 27, 2015, with English translation.

Notification of Reasons for Rejection issued in Japanese Patent Application No. 2013-011044 dated Feb. 24, 2015, with partial English translation.

European Search Report issued in EP Application No. 13163328.1 dated Aug. 7, 2014.

Taiwanese Office Action dated Feb. 22, 2017, issued in Taiwanese Patent Application No. 102113139, with English language translation.

Final Office Action dated May 15, 2017, issued in corresponding U.S. Appl. No. 13/861,894.

* cited by examiner

FIG.1

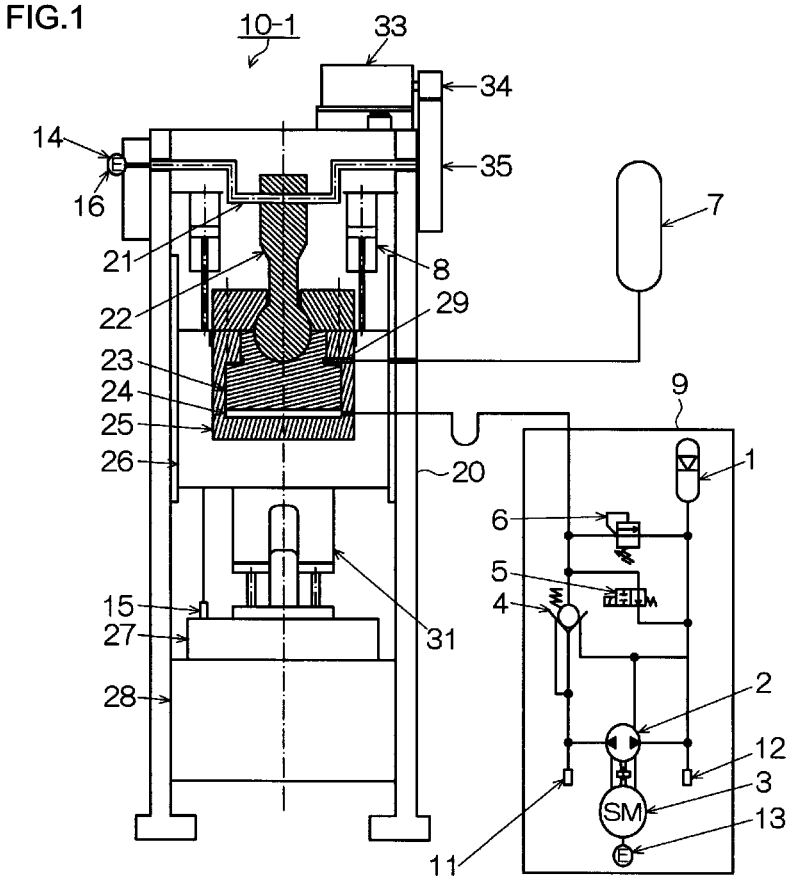

1: ACCUMULATOR
2: HYDRAULIC PUMP/MOTOR
3: SERVOMOTOR
4: PILOT OPERATION / CHECK VALVE
5: SOLENOID VALVE
6: RELIEF VALVE (SAFETY VALVE)
7: AIR TANK
8: BALANCER CYLINDER
9: HYDRAULIC CIRCUIT
11: PRESSURE DETECTOR (SLIDE BUILT-IN CYLINDER HYDRAULIC CHAMBER)
12: PRESSURE DETECTOR (DRIVE APPARATUS/SYSTEM PRESSURE)
13: ANGULAR SPEED DETECTOR (SERVOMOTOR)
14: ANGULAR SPEED DETECTOR (CRANKSHAFT)
15: POSITION DETECTOR (SLIDE)
16: ANGLE DETECTOR (CRANKSHAFT)
21: CRANKSHAFT
22: CON ROD
23: SLIDE BUILT-IN PISTON
24: LOWERING-SIDE HYDRAULIC CHAMBER IN SLIDE
25: SLIDE BUILT-IN CYLINDER
26: SLIDE
27: BOLSTER
28: BED
29: RAISING-SIDE HYDRAULIC CHAMBER IN SLIDE
31: DIE
33: SERVOMOTOR
34: GEAR
35: MAIN GEAR 41a, 41b: SERVOMOTOR
42a, 42b: SCREW
43a, 43b: NUT
44: SLIDE PLATE 41a, 41b: SERVOMOTOR
42a, 42b: ROTATION TRANSMITTING SHAFT
45a, 45b: PINION
46: RACK-EQUIPPED SLIDE PLATE

SLIDE MOTION CONTROL APPARATUS FOR MECHANICAL PRESS

CROSS-REFERENCE TO RELATED APPLICATIONS

This Application is a Divisional Application of U.S. patent application Ser. No. 13/861,894 filed Apr. 12, 2013, now U.S. Pat. No. 9,815,251 which in turn claims priority to Japanese Patent Application No. 2013-011044 filed Jan. 24, 2013 and Japanese Patent Application No. 2012-091849 filed Apr. 13, 2012. The subject matter of each is incorporated herein by reference in entirety.

BACKGROUND OF THE INVENTION

Field of the Invention

The present invention relates to a slide motion control apparatus for a mechanical press, and in particular, to a technology that controls a slide of the mechanical press driven by a crank or a link mechanism with respect to a tip portion of a con rod (con rod tip).

Description of the Related Art

Conventionally, as this kind of mechanical press, there have been ones set forth in Japanese Patent Application Laid-Open No. 2011-194466 and Japanese Patent Application Laid-Open No. 2001-062597.

In a press machine set forth in Japanese Patent Application Laid-Open No. 2011-194466, a hydraulic cylinder mechanism is arranged between a tip of a connecting member (con rod) that connects a crankshaft and a slide and the slide, a servomotor for rotating a main shaft of a mechanical press is stopped at a position where the main shaft has been rotated 180 degrees from an upper dead center position, also pressure oil is supplied to the hydraulic cylinder mechanism, and the slide is further pushed down.

Namely, an invention set forth in Japanese Patent Application Laid-Open No. 2011-194466 is a complex type (hybrid type) of press machine that performs press working by mechanical mechanisms, such as a crank mechanism driven by the servomotor, and press working by the hydraulic cylinder mechanism near a bottom dead center of the slide. Particularly, the press machine performs press working by the mechanical mechanism to the position where the main shaft of the press machine has been rotated 180 degrees from the upper dead center position, subsequently, stops the servomotor for rotating the crankshaft, as well as makes the slide operate by the hydraulic cylinder mechanism incorporated between the con rod tip and the slide, and performs so-called "bottoming" or "ramming" working. As a result, deep drawing of a workpiece can be performed, and additionally, the workpiece is slowly press-worked by the hydraulic cylinder mechanism, thereby a crack or the like does not occur in the workpiece, and also springback is prevented from occurring.

A pressure apparatus set forth in Japanese Patent Application Laid-Open No. 2001-062597, a first slider moves to a previously set position by first drive means (a first screw mechanism or crank mechanism), a second slider moves to a predetermined position (fixed point position) by second drive means (a second screw mechanism) that relatively moves to the first slider, and thereby a workpiece existing between the second slider and a substrate is pressed.

In an invention set forth in Japanese Patent Application Laid-Open No. 2001-062597, two drive means of the first drive means that drives the first slider and the second drive means that drives the second slider are used, as the first drive means, means (means with a large pitch in a case of the screw mechanism) is used that can move the first slider to the previously set position (near a fixed point working position) in a short time, and as the second drive means, means (means with a small pitch in a case of the screw mechanism) is used that can accurately position the second slider to a fixed point position, whereby positioning accuracy at the fixed point working position is improved, and also a large pressure force can be obtained.

SUMMARY OF THE INVENTION

A control apparatus of the press machine set forth in Japanese Patent Application Laid-Open No. 2011-194466 performs control in which the servomotor stops at the position where the main shaft of the crank mechanism driven by the servomotor has been rotated by 180 degrees from the upper dead center position, pressure oil is supplied to the hydraulic cylinder apparatus during the stop, and in which the slide moves to a position that has been pushed down to the lowest, but it does not continuously perform position control of a position of the slide during press working.

Similarly, the pressure apparatus set forth in Japanese Patent Application Laid-Open No. 2001-062597 has a position detecting apparatus (linear scale) that detects a position of the second slider. In the pressure apparatus, the second slider fixed to a predetermined positional relation to the first slider based on a position signal detected by the position detecting apparatus moves the first slider from an initial position H0 until it reaches a previously set position H1, and subsequently, the second slider moves from the position H1 to a predetermined position H (fixed point position) by the second drive means. However, because the position detecting apparatus detects only the position of the second slider, the position of the second slider cannot be controlled while the first and second sliders are simultaneously moved by the first and second drive means.

In addition, Japanese Patent Application Laid-Open No. 2011-194466 sets forth the press machine (servo press) that drives the crank mechanism by the servomotor. Generally, there has been such a problem that although a servo press can arbitrarily set a position, speed, etc. of a slide, variable speed responsiveness of the slide is low since a mass of the slide, and inertia of a rotating shaft of a servomotor and a crankshaft are large. In the invention set forth in Japanese Patent Application Laid-Open No. 2011-194466, rotation of the main shaft (servomotor) of the mechanical press stops at the position where the main shaft has been rotated by 180 degrees from the upper dead center position, and in the invention set forth in Japanese Patent Application Laid-Open No. 2001-062597, the first drive means is stopped when the slide reaches the predetermined position. However, such stop control cannot be achieved accurately while obtaining high-speed responsiveness.

The present invention is made in view of such circumstances, and the present invention aims to provide a slide motion control apparatus for a mechanical press that can change of slide motion easily, compactly, and inexpensively in a crank-driven or link-driven mechanical press, and can remarkably improve variable speed responsiveness of a slide compared to a servo press that drives a conventional crankshaft by a servomotor.

In order to achieve the above-described object, a slide motion control apparatus for a mechanical press pertaining to one aspect of the present invention is characterized by including: a slide which is disposed so as to be relatively vertically movable with respect to a driven body to which a drive force is transmitted through a con rod of the mechanical press; a relative position command unit that outputs a relative position command indicating a relative position of the slide with respect to the driven body; a relative position detecting unit that detects a relative position of the slide with respect to the driven body, and outputs a relative position detecting signal indicating the detected relative position; a servomotor; a drive mechanism that relatively moves the slide with respect to the driven body by a drive force of the servomotor; and a control unit that controls the servomotor based on a relative position command signal output from the relative position command unit, and the relative position detecting signal output from the relative position detecting unit.

According to the one aspect of the present invention, the servomotor of the drive mechanism is controlled based on the relative position command signal output from the relative position command unit, and the relative position detecting signal output from the relative position detecting unit, and the slide is relatively moved with respect to the driven body by the drive force of the servomotor. Therefore, independent from the driven body driven by the drive force being transmitted through the con rod of the mechanical press, the relative position of the slide with respect to the driven body can be controlled.

In a case of a current mainstream mechanical press (servo press) in which a crankshaft is driven by a servomotor, slide motion can be changed, but variable speed responsiveness of the slide motion is low. Meanwhile, in a case of a general mechanical press in which a crankshaft is driven by a flywheel, slide motion cannot be changed. However, according to the one aspect of the present invention, since the relative position of the slide with respect to the driven body is controlled independently from the driven body, a position of the slide can be controlled from a position of the driven body and the relative position of the slide. Particularly, even when variable speed responsiveness of position control of the driven body is low or variable control cannot be performed, because the slide which is disposed so as to be relatively vertically movable with respect to the driven body has a smaller mass than that of the driven body, is not affected by inertia of a rotational drive mechanism that drives the driven body, the relative position of the slide (slide motion) is superior in responsiveness compared with control of the position of the driven body.

In a slide motion control apparatus for a mechanical press pertaining to another aspect of the present invention, the relative position command unit outputs a relative position command signal for vibrating the slide. The relative position command signal for vibrating the slide is output from the relative position command unit, and thereby the slide can be vibrated independently of a driven body. This allows to prevent lack of an oil film on a material surface, and to have a good surface condition on the worked workpiece.

In a slide motion control apparatus for a mechanical press pertaining to still another aspect of the present invention, the mechanical press continuously moves the driven body through the con rod at least for a press working period. Namely, control of stopping the driven body, etc. is not performed for the press working period, and the driven body operates similarly to the slide of a usual mechanical press.

In a slide motion control apparatus for a mechanical press pertaining to still another aspect of the present invention, the relative position command unit outputs a relative position command signal corresponding to a movement position of the driven body for a predetermined period of time while the driven body is moving. As a result, a relative position of a slide is controlled with respect to the moving driven body while the driven body is moving, and a position of the slide is controlled by a position of the driven body, and the relative position of the slide with respect to the driven body.

A slide motion control apparatus for a mechanical press pertaining to still another aspect of the present invention further includes an angular speed detecting unit that detects an angular speed of the servomotor, wherein the control unit controls the servomotor based on a second operation amount corresponding to a deviation between an angular speed signal detected by the angular speed detecting unit and a first operation amount corresponding to a deviation between the relative position command signal and the relative position detecting signal. As a result, dynamic stability is secured (a delayed phase is corrected).

In a slide motion control apparatus for a mechanical press pertaining to still another aspect of the present invention, the relative position command unit has: a target speed command unit that outputs a target speed command signal of the slide; a speed detecting unit that detects a speed of the driven body; a subtractor that calculates a difference between the target speed command signal commanded by the target speed command unit and a speed signal of the driven body detected by the speed detecting unit; and an integrator that integrates the difference calculated by the subtractor, and the relative position command unit outputs an integration signal integrated by the integrator as the relative position command signal. This allows to easily generate the relative position command signal from the target speed command signal of the slide.

In a slide motion control apparatus for a mechanical press pertaining to still another aspect of the present invention, the relative position command unit has: a target position command unit that outputs a target position command signal of the slide; a position detecting unit that detects a position of the driven body; and a subtractor that calculates a difference between the target position command signal commanded by the target position command unit and a position signal of the driven body detected by the position detecting unit, and the relative position command unit outputs a differential signal calculated by the subtractor as the relative position command signal. This allows to easily generate the relative position command signal from the target position command signal of the slide, and the position signal of the detected driven body.

In a slide motion control apparatus for a mechanical press pertaining to still another aspect of the present invention, the relative position command unit has: a first target position command unit that outputs a first target position command signal of the slide; a second target position command unit that outputs a second target position command signal of the driven body; and a subtractor that calculates a difference between the first target position command signal output from the first target position command unit and the second target position command signal output from the second target position command unit, and the relative position command unit outputs a differential signal calculated by the subtractor as the relative position command signal. The relative position command signal can easily be generated from the first target position command signal of the slide, and the second target position command signal of the driven body.

In a slide motion control apparatus for a mechanical press pertaining to still another aspect of the present invention, the relative position detecting unit has: a slide position detecting unit that detects a position of the slide; a driven body position detecting unit that detects a position of the driven body; a subtractor that calculates a difference between a slide position detecting signal output from the slide position detecting unit and a driven body position detecting signal output from the driven body position detecting unit, and the relative position detecting unit outputs a differential signal calculated by the subtractor as the relative position detecting signal. This allows to detect the relative position without providing a position detecting unit that directly detects the relative position of the slide with respect to the driven body.

In a slide motion control apparatus for a mechanical press pertaining to still another aspect of the present invention, the drive mechanism includes: a cylinder-piston mechanism provided in the slide; and a fluid pressure pump/motor that is driven by the servomotor and supplies a pressure fluid to a fluid pressure chamber of the cylinder-piston mechanism.

In a slide motion control apparatus for a mechanical press pertaining to still another aspect of the present invention, the drive mechanism includes a screw mechanism including a screw portion and a nut portion that are provided between the driven body and the slide, and a power transmitting unit that transmits the drive force of the servomotor to the screw portion or the nut portion.

In a slide motion control apparatus for a mechanical press pertaining to still another aspect of the present invention is characterized in that the drive mechanism includes a rack and pinion mechanism provided between the driven body and the slide, and a power transmitting unit that transmits the drive force of the servomotor to a pinion of the rack and pinion mechanism.

In a slide motion control apparatus for a mechanical press pertaining to still another aspect of the present invention, a plurality of the relative position detecting unit, a plurality of servomotors, and a plurality of drive mechanisms are respectively provided, the plurality of relative position detecting unit detect a plurality of relative positions of the slide with respect to the driven body, respectively, and output relative position detecting signals indicating the detected relative positions, respectively, the plurality of drive mechanisms relatively move the slide with respect to the driven body by drive forces of the plurality of servomotors, and that the control unit controls the plurality of servomotors, respectively, based on the relative position command signal output from the relative position command unit, and the plurality of relative position detecting signals output from the plurality of relative position detecting unit. This enables to control the slide so as not to incline even though an eccentric load is applied to the slide.

In a slide motion control apparatus for a mechanical press pertaining to still another aspect of the present invention, the slide is a plurality of inner slides which are respectively disposed so as to be vertically movable with respect to the driven body, the plurality of relative position detecting unit respectively detect relative positions of the plurality of inner slides with respect to the driven body, the plurality of drive units relatively move the plurality of inner slides respectively and independently.

In a slide motion control apparatus for a mechanical press pertaining to still another aspect of the present invention, the relative position command unit respectively outputs relative position commands indicating the relative positions of the plurality of inner slides with respect to the driven body, the control unit controls the plurality of servomotors, respectively, based on the plurality of relative position command signals which correspond to the plurality of inner slides and are output from the relative position command unit, and the plurality of relative position detecting signals output from the plurality of relative position detecting unit. As a result, the positions of the plurality of inner slides can be controlled individually, and even when a thickness of a material (workpiece) to be press-worked partially differs, a large eccentric load can be prevented from acting on the mechanical press.

According to the present invention, the servomotor of the drive mechanism that relatively moves the slide with respect to the driven body is controlled based on the relative position command signal indicating the relative position of the slide with respect to the driven body, and the relative position detecting signal detected by the relative position detecting unit, wherein the slide being disposed so as to be relatively vertically movable with respect to the driven body to which the drive force is transmitted through the con rod of the mechanical press. Therefore, independently from the driven body driven by the drive force being transmitted through the con rod of the mechanical press, the relative position of the slide with respect to the driven body can be controlled. Particularly, since the slide which is disposed so as to be relatively vertically movable with respect to the driven body has a smaller mass than that of the driven body, and is not affected by inertia of the rotational drive mechanism that drives the driven body, etc., variable speed responsiveness of the slide can be remarkably improved.

BRIEF DESCRIPTION OF THE DRAWINGS

FIG. 1 is a configuration diagram showing a mechanical press to which a first embodiment of a slide motion control apparatus for the mechanical press pertaining to the present invention is applied, and a drive mechanism including a hydraulic circuit for the slide motion control apparatus;

DETAILED DESCRIPTION OF THE PREFERRED EMBODIMENTS

Figure 2:
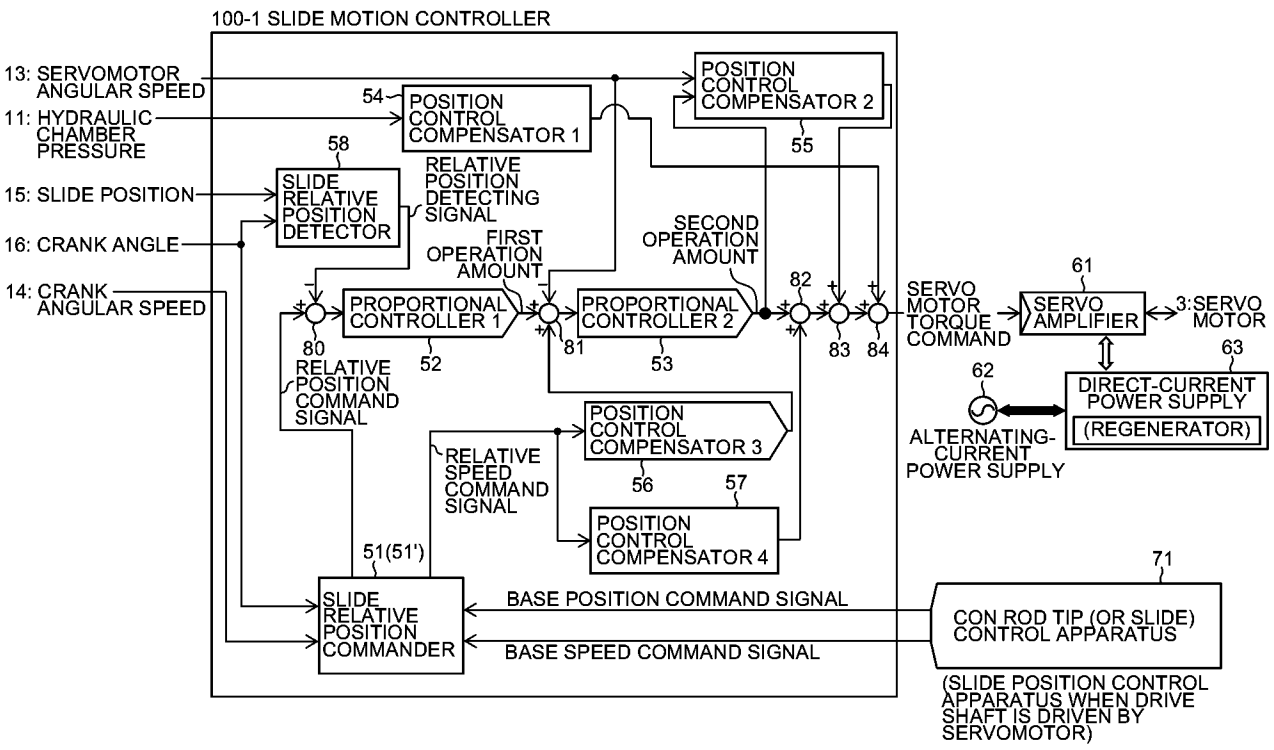
FIG. 2 is a block diagram showing the first embodiment of a control unit of the slide motion control apparatus for the mechanical press shown in FIG. 1.

Hereinafter, there will be described in detail preferred embodiments of a slide motion control apparatus for a mechanical press pertaining to the present invention in accordance with the accompanying drawings.

[Configuration of Slide Motion Control Apparatus for Mechanical Press (First Embodiment)]

<Structure of Mechanical Press>

FIG. 1 is a configuration diagram showing a mechanical press to which a first embodiment of a slide motion control apparatus for the mechanical press pertaining to the present invention is applied, and a drive mechanism including a hydraulic circuit for the slide motion control apparatus.

A mechanical press 10-1 shown in FIG. 1 has: a column (frame) 20; a slide 26; a bolster 27 on a bed 28; etc., and the slide 26 is movably guided in a perpendicular direction by a guide portion provided to the column 20.

A cylinder-piston mechanism including a slide built-in cylinder (i.e., cylinder with built-in slide) 25 and a slide built-in piston (i.e., piston with built-in slide) 23 is provided in the slide 26, and a tip of a con rod 22 provided to a crankshaft 21 is connected to the slide built-in piston 23. A rotational driving force is transmitted to the crankshaft 21 through a servomotor 33, a gear 34 and a main gear 35. When the crankshaft 21 rotates by the servomotor 33, the slide 26 moves in a vertical direction on FIG. 1 together with the slide built-in piston 23 (driven body) by a drive force applied through the crankshaft 21 and the con rod 22.

In addition, the slide 26 is integrated with the slide built-in cylinder 25, and can relatively move (up and down) in the vertical direction with respect to the slide built-in piston 23 (driven body). Pressure oil can be supplied from a hydraulic circuit 9 to a lowering-side hydraulic chamber 24 in a slide of the cylinder-piston mechanism, and the pressure oil supplied from the hydraulic circuit 9 becomes a power source to relatively lower the slide 26 with respect to a con rod tip (the slide built-in piston 23). In addition, the power source that relatively raises the slide 26 with respect to the con rod tip is supplied by a force generated by supplying an air pressure from an air tank 7 to a raising-side hydraulic chamber 29, or by thrust of a balance cylinder 8.

A slide position detector 15 that detects a position of the slide 26 is provided on a side (bolster side) of the bolster 27 of the mechanical press 10-1, and an angular speed detector 14 (angular speed detecting unit) and an angle detector 16 (angle detecting unit) that detect an angular speed and an angle of the crankshaft 21 are provided at the crankshaft 21. Note that the angular speed detector 14 may be a one which obtains an angular speed signal by differentiating an angle signal output from the angle detector 16.

An upper die 31*a* is attached to the slide 26, and a lower die 31*b* is attached to the bolster 27. A die 31 (the upper die 31*a* and the lower die 31*b*) in the example is the die to be used for molding of an upwardly-closed, hollow cup-shaped (drawing-shaped) product.

<Hydraulic Circuit for Slide Motion Control Apparatus>

The hydraulic circuit 9 of the slide motion control apparatus pertaining to the present invention is mainly constituted by: an accumulator 1; a hydraulic pump/motor 2; a servomotor 3 connected to a rotating shaft of the hydraulic pump/motor 2; a pilot operation check valve 4; a solenoid valve 5; and a relief valve 6.

Approximately 1 to 5 kg/cm$^2$ of gas pressure is set in the accumulator 1, and the accumulator 1 stores operating oil in a low pressure state (substantially constant low voltage) of approximately not more than 10 kg/cm$^2$, and serves as a tank.

One port of the hydraulic pump/motor 2 is connected to the lowering-side hydraulic chamber 24 in the slide through the pilot operation check valve 4, the other port thereof is connected to the accumulator 1, and the hydraulic pump/motor 2 rotationally operates in a positive direction (to a side on which the lowering-side hydraulic chamber 24 is pressurized), and in an opposite direction (a side on which the lowering-side hydraulic chamber 24 is depressurized) according to torque applied from the servomotor 3, and a hydraulic pressure force acting on both ports.

The pilot operation check valve 4 enables a pressure of the lowering-side hydraulic chamber 24 to be kept constant in a region of an non-working process (at least an upper half of a slide stroke) in one cycle operation of pressing (slide) in order to reduce a load of the servomotor 3 (plus the hydraulic pump/motor 2) even though the servomotor 3 is in an unloaded state (zero torque state), and keeps the slide 26 at a lowered end (limit) with respect to the slide built-in piston 23. A pressure that acts on a port of the lowering-side hydraulic chamber 24 of the hydraulic pump/motor 2 is, as one example, used for pilot operation.

The solenoid valve 5 serves to forcibly eliminate the pressure acting on the lowering-side hydraulic chamber 24. The solenoid valve 5 is not used at a usual time (at the time of functioning), and is used at the time of maintenance (before disassembling of a machine), etc.

The relief valve 6 serves to release the pressure oil to a substantially constant low voltage (accumulator 1) side when an unexpected abnormal pressure acts on the lowering-side hydraulic chamber 24, aside from a pressure normally generated along with control of a motion.

In addition, the pressure that acts on the port of the lowering-side hydraulic chamber 24 of the hydraulic pump/motor 2 (the pressure of the lowering-side hydraulic chamber 24 when the pilot operation check valve 4 is open), and the pressure that acts on the port on the accumulator side of the hydraulic pump/motor 2 are detected by pressure detectors 11 and 12, respectively, and an angular speed of the servomotor 3 is detected by the angular speed detector 13.

<Control Unit of Slide Motion Control Apparatus (First Embodiment)>

FIG. 2 is a block diagram showing the first embodiment of a control unit of the slide motion control apparatus for the mechanical press shown in FIG. 1.

As shown in FIG. 2, control unit (a slide motion controller) 100-1 of the first embodiment is mainly constituted by: a slide relative position commander (relative position command unit) 51; proportional controllers 52 and 53; position control compensators 54, 55, 56, and 57; a slide relative position detector (relative position detecting unit) 58; a subtractor 80; an adder subtractor 81; and adders 82, 83, and 84.

Control by the slide motion controller 100-1 is basically performed by driving the servomotor 3 based on a second operation amount signal (torque command basic signal of the servomotor 3) which is obtained by amplifying a deviation amount (second deviation amount) between a first operation amount signal and an angular speed signal of the servomotor 3 through the proportional controller 53, the first operation amount signal which is obtained by amplifying through the proportional controller 52, a deviation amount (first deviation amount) between a relative position command signal and a relative position detecting signal, in order to make the relative position detecting signal follow the relative position command signal of the slide 26 with respect to the con rod tip. The proportional controller 52 manages relative position control, and the proportional controller 53 manages action of securing dynamic stability (returning a delayed phase).

The position control compensators 54, 55, 56, and 57 are not absolutely required in order to achieve the present invention, but they are preferably attached in order to improve controllability. The position control compensator 54 corrects a force due to the hydraulic pressure acting on hydraulic cylinders (the slide built-in cylinder 25 and the slide built-in piston 23), and an unbalanced force due to gravity. The position control compensator 55 reduces an effect by a force (for example, a molding force) acted on a control system from outside. The position control compensators 56 and 57 are the compensators that reduce a steady deviation between the relative position detecting signal with respect to the relative position command signal (assume a so-called feed-forward action).

Hereinafter, the slide motion controller 100-1 will be specifically described.

The slide relative position commander 51 outputs a relative position command indicating a relative position of the slide 26 with respect to the slide built-in piston 23 (driven body) driven through the con rod 22, and an angle signal and an angular speed signal indicating the angular speed and the angle of the crankshaft 21 are added from the angular speed detector 14 and the angle detector 16. In addition, the mechanical press of the embodiment is a servo press that drives the crankshaft 21 by the servomotor 33, and includes a control apparatus 71 that controls a position and a speed of the con rod tip (or the slide). A base position command signal and a base speed command signal for commanding the position and the speed of the con rod tip are added to the slide relative position commander 51 from the control apparatus 71.

Figure 3:
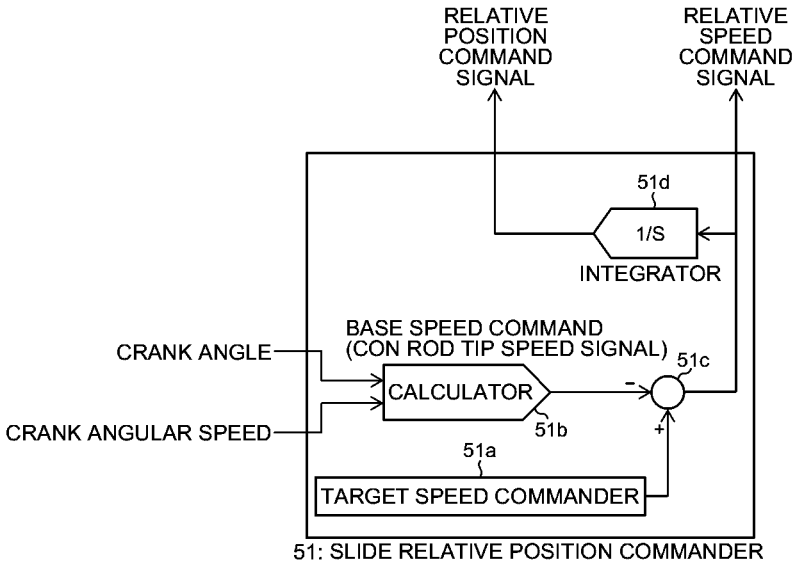
FIG. 3 is a block diagram showing an embodiment of a slide relative position commander.

FIG. 3 is a block diagram showing the embodiment of the slide relative position commander 51.

The slide relative position commander 51 shown in FIG. 3 is constituted by: a target speed commander 51*a* (first target speed command unit); a calculator 51*b* (second target speed command unit); a subtractor 51*c*; and an integrator 51*d*.

Figure 4A:
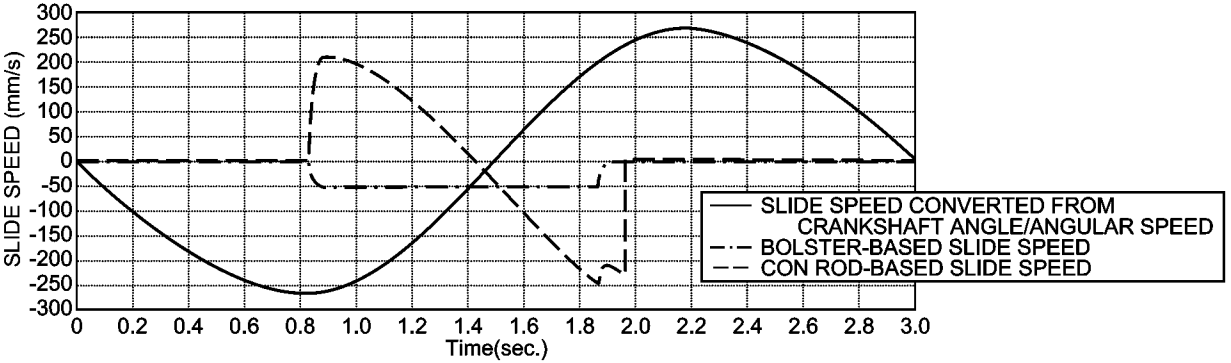
FIGS. 4A and 4B are waveform charts showing bolster-based slide speeds and positions, con rod-based slide speeds and positions, and speeds and positions of a con rod tip.

The target speed commander 51*a* outputs a target speed command signal of the slide 26 for a predetermined period of time in a press cycle, and outputs −50 mm/second target speed command signal (a bolster-based slide speed) for approximately 0.85 to 1.9 seconds in a case where one cycle of pressing is 0 to 3 seconds on a wave form indicated with an alternate long and short dash line of FIG. 4A of the example. Note that in the example, a speed in a lowering direction of the slide 26 is set as a negative.

A crank angle signal and a crank angular speed signal are added to the calculator 51*b*, and the calculator 51*b* calculates (converts) a base speed signal (con rod tip speed signal) by the two inputs.

The target speed command signal and the base speed signal are added to the subtractor 51*c* from the target speed commander 51*a* and the calculator 51*b*, respectively, and the subtractor 51*c* outputs a difference signal (con rod-based slide speed signal) obtained by subtracting the base speed signal from the target speed command signal (refer to a wave form indicated with a broken line of FIG. 4A). Note that the subtractor 51*c* performs the above-described subtraction only in a predetermined working region (for approximately 0.85 to 1.9 seconds in the example) in one cycle of pressing, and outputs zero as the con rod-based slide speed signal for the other period.

Figure 4B:
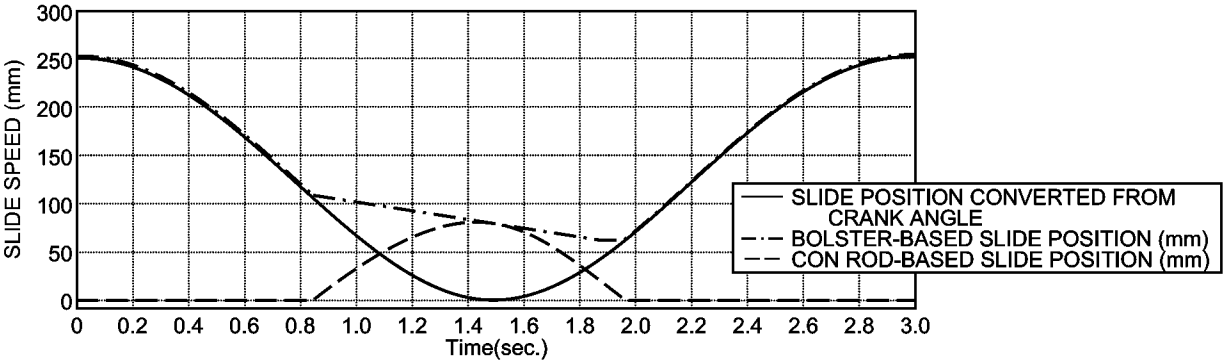

The integrator 51*d* integrates the con rod-based slide speed signal output from the subtractor 51*c*, and outputs the integrated value as a con rod-based slide position signal (relative position command signal) (refer to a wave form indicated with a broken line of FIG. 4B).

Note that the base speed command signal added from the con rod tip control apparatus 71 may be used instead of the base speed signal calculated by the calculator 51*b*. In addition, the slide relative position commander 51 can separately output the con rod-based slide speed signal (relative speed command signal) from the subtractor 51*c*.

Returning to FIG. 2, the slide relative position commander 51 outputs the relative position command signal to the subtractor 80 and the position control compensators 56 and 57.

A bolster-based slide position signal and the crank angle signal are added to the slide relative position detector 58 from the slide position detector 15 and the angle detector 16, respectively. The slide relative position detector 58 detects a con rod-based slide position (relative position) based on a con rod tip position and a bolster-based slide position that have been converted from the crank angle signal, and outputs the relative position detecting signal indicating the relative position to the subtractor 80.

The subtractor 80 calculates a deviation (deviation signal (first deviation amount) obtained by subtracting the relative position detecting signal from the relative position command signal) of two inputs, and outputs the deviation signal to the proportional controller 52. The proportional controller 52 amplifies the inputted deviation signal, and outputs the amplification result to the adder subtractor 81 as the first operation amount signal.

The angular speed signal indicating the angular speed of the servomotor 3 from the angular speed detector 13, and a feed-forward signal for modifying the first operation amount corresponding to the relative speed command signal from the position control compensator 56 are added to the adder subtractor 81 as other inputs. The adder subtractor 81 calculates a deviation (second deviation amount) between the first operation amount signal and the angular speed signal, adds the feed-forward signal to the deviation signal, and outputs it to the proportional controller 53. The proportional controller 53 amplifies the input signal, and outputs the amplification result to the adder 82 as the second operation amount signal.

A feed-forward signal for modifying the second operation amount corresponding to the relative speed command signal is added to the adder 82 as another input from the position control compensator 57, and the adder 82 adds the feed-forward signal to the second operation amount signal, and outputs the added signal to the adder 83. A feed-forward signal generated based on the angular speed signal of the servomotor 3 and the second operation amount signal is added to the adder 83 as another input from the position control compensator 55. The adder 83 outputs to the adder 84 a signal obtained by adding two input signals. A feed-forward signal corresponding to the pressure of the lowering-side hydraulic chamber 24 detected by the pressure detector 11 is added to the adder 84 as another input from the position control compensator 54. The adder 83 outputs a signal obtained by adding two input signals to a servo amplifier 61 as a torque command signal of the servomotor 3.

The slide motion controller 100-1 calculates the torque command signal for controlling torque of the servomotor 3 as described above, outputs the calculated torque command signal to the servomotor 3 through the servo amplifier 61, drives hydraulic cylinder mechanisms (the slide built-in cylinder 25 and the slide built-in piston 23) through the hydraulic pump/motor 2 driven by the servomotor 3, and performs control so that the relative position of the slide 26 follows the relative position command.

Note that when the pressure of the lowering-side hydraulic chamber 24 of the hydraulic cylinder mechanism is reduced after press working, rotating shaft torque generated in the hydraulic pump/motor 2 exceeds drive torque of the servomotor 3, the hydraulic pump/motor 2 acts as a hydraulic motor, and rotates the servomotor 3 (regeneration action). An electric power generated by the regeneration action of the servomotor 3 is regenerated to an alternating-current power supply 62 through the servo amplifier 61 and a direct-current power supply 63 with a power regeneration function.

[Description of One Cycle Operation of Pressing]

Next, slide motion in one cycle operation of pressing will be described with reference to waveform charts shown in FIG. 4.

Although the mechanical press shown in FIG. 1 is a servo press that drives the crankshaft 21 with a drive force of the servomotor 33, the wave forms shown in FIG. 4 indicate slide motion etc. when the slide motion control apparatus pertaining to the present invention is applied to a general mechanical press with a stroke of 250 mm that drives the crankshaft 21 by a flywheel at a constant angular speed of 20 spm (the number of strokes/minute).

<A: Non-working Process>

In a case where a con rod tip position (slide position converted from crank angle) is located in an non-working region including an upper dead center (approximately 0 to 0.8 seconds and 2 to 3 seconds on the wave form in the example), the slide 26 is controlled at a lowest (most projecting) position with respect to a tip of the con rod 22 (a relative slide position is zero). At this time, an hydraulic pressure generated at a port on one side of the hydraulic pump/motor 2 in proportion to the torque of the servomotor 3 acts on the lowering-side hydraulic chamber 24 of the hydraulic cylinder mechanism so as to resist a force of raising the slide 26 generated by an air pressure of the air tank 7 acting on the hydraulic cylinder and the raising-side hydraulic chamber 29. The pilot operation check valve 4 is opened by the hydraulic pressure.

<B: Working Process>

In a working region (approximately 0.8 to 2 seconds on the wave form in the example), when a con rod position (slide position converted from crank angle) becomes 110 mm, the slide relative position commander 51 calculates and outputs a relative position command signal (wave form indicated with the broken line of FIG. 4B) and a relative speed command signal (wave form indicated with the broken line of FIG. 4A) so that the slide 26 becomes a bolster-based target speed command (−50 mm/s).

The slide motion controller 100-1 generates a torque command signal of the servomotor 3 based on the relative position command signal and the relative speed command signal that are output from the slide relative position commander 51, slide relative position detecting signals to be detected respectively, the angular speed signal of the servomotor 3, etc, and controls drive of the servomotor 3 through the servo amplifier 61 in order to control the relative position of the slide 26.

The hydraulic pressure that acts on the lowering-side hydraulic chamber 24 of the hydraulic cylinder mechanism (generated at the a port on one side of the hydraulic motor) acts according to a load associated with working. By action of the position control compensators 54, 55, 56, and 57, regardless of a scale of the load (scale of the hydraulic pressure), control with stability and good accuracy (with few position deviation (between the relative position command signal and the relative position detecting signal)) is performed.

Eventually, in the working region, while the crankshaft 21 is rotating at a constant speed of 20 spm, the slide 26 based on the bolster 27 is controlled at a constant speed of −50 mm/s for approximately 0.8 to 2 seconds (more particularly, 0.85 to 1.9 seconds) (refer to the wave form indicated with the alternate long and short dash line of FIG. 4A). It becomes possible to reduce shock at the time of contact of the upper and lower dies, or to stabilize moldability. In the example, as a result, a bottom dead center of the slide is higher by 60 mm than the bottom dead center converted from a crankshaft angle.

Next, other slide motion in one cycle operation of pressing will be described with reference to a waveform chart shown in FIG. 5.

Figure 5:
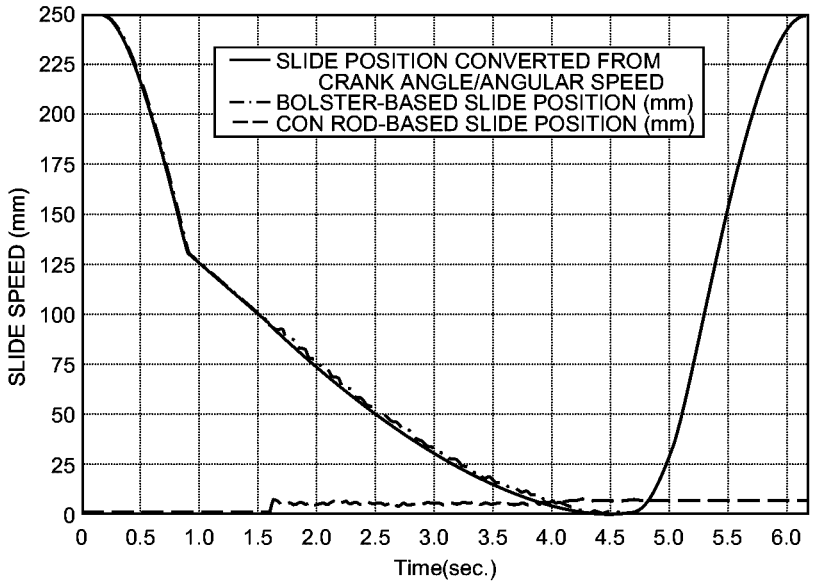
FIG. 5 is a waveform chart showing bolster-based slide positions, con rod-based slide positions, and positions of the con rod tip.

The wave forms shown in FIG. 5 indicate slide motion when the slide motion control apparatus pertaining to the present invention is applied to a general (motor-driven) servo press with a stroke of 250 mm in which the crankshaft 21 is driven by the servomotor 33 as shown in FIG. 1.

<A: Non-working Process>

In a case where the con rod tip position (slide position converted from crankshaft angle) is located in an non-working region including the upper dead center (approximately 0 to 1.6 seconds and after 4.5 seconds on the wave form in the example), the slide 26 is controlled at the lowest (most projecting) position with respect to the tip of the con rod 22 (the relative slide position is zero). At this time, the hydraulic pressure generated at a port on one side of the hydraulic pump/motor 2 in proportion to the torque of the servomotor 3 acts on the lowering-side hydraulic chamber 24 of the hydraulic cylinder mechanism so as to resist a force of raising the slide 26 by the balance cylinder 8. The pilot operation check valve 4 is opened by the hydraulic pressure.

<B: Working Process>

In a working region (approximately 1.6 to 4.2 seconds on the wave form in the example), when the con rod position (slide position converted from crank angle) becomes 90 mm, a slide relative position commander 51' calculates and outputs the relative position command signal and the relative speed command signal so as to give vibration with an amplitude of 1 mm and a frequency of 10 Hz ($\sin(2\pi \cdot 10(\mathrm{Hz}) \cdot t(s))$) to the con rod tip (or the slide) controlled by the control apparatus 71 of the servo press.

Here, the control apparatus 71 (FIG. 2) of the servo press controls the position and the speed of the con rod tip (or the slide) based on the base position command signal and the base speed command signal, and thereby performs control so as to have desired slide motion as indicated with a continuous line of FIG. 5. However, since a mass of the slide 26, and inertia of a rotating shaft of the servomotor 33, the main gear 35 and the crankshaft 21 are large, a frequency response of the slide motion is approximately 1 Hz.

Figure 6:
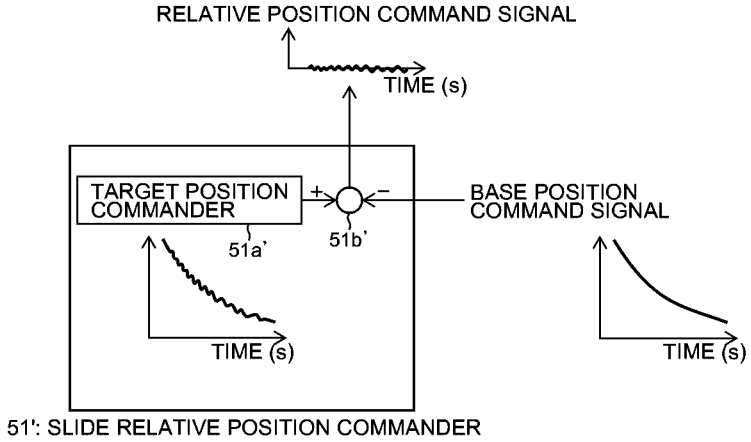
FIG. 6 is a block diagram showing another embodiment of the slide relative position commander.

The slide relative position commander 51' includes a target position commander 51*a*' and s subtractor 51*b*' as shown in FIG. 6.

The target position commander 51*a*' outputs a target position command signal of the slide 26 for a predetermined period of time in the pressing cycle, and outputs to the subtractor 51*b*' a target position command signal with a value obtained by adding vibration with the amplitude of 1 mm and the frequency of 10 Hz to a base position (slide position converted from crank angle) in the working region (approximately 1.6 to 4.2 seconds on the wave form in the example) as shown by the wave form indicated with the alternate long and short dash line of FIG. 5.

The base position command signal is added to the subtractor 51*b*' as another input from the control apparatus 71 for the servo press (refer to FIG. 2), and the subtractor 51*b*' calculates a deviation between the inputted target position command signal and the base position command signal, and outputs the deviation signal as the relative position command signal (a broken line of FIG. 5).

The slide motion controller 100-1 generates the torque command signal of the servomotor 3 based on the relative position command signal output from the slide relative position commander 51', the slide relative position detecting signal, the angular speed signal of the servomotor 3, etc, and controls drive of the servomotor 3 through the servo amplifier 61, in order to control the relative position of the slide 26.

The hydraulic pressure that acts on the lowering-side hydraulic chamber 24 of the hydraulic cylinder mechanism (generated at a port on one side of the hydraulic motor) acts according to the load associated with working. By action of the position control compensators 54, 55, 56, and 57, regardless of the scale of the load (scale of the hydraulic pressure), control with stability and good accuracy (with few position deviation (between the relative position command signal and the relative position detecting signal)) is performed.

Eventually, in the working region, while the crankshaft 21 is rotating at a constant speed of 10 spm (shots per minute), the slide 26 based on the bolster 27 is controlled so that vibration of 10 Hz with the amplitude of 1 mm is given to the slide position (base position) controlled by the control apparatus 71 of the servo press.

Such vibration is given to the slide 26, and thereby lack of an oil film on a material surface can be prevented, and a worked surface can be made good.

Note that the slide relative position commander 51' shown in FIG. 6 calculates the deviation between the target position command signal and the base position command signal, and generates the relative position command signal for giving the vibration, but the present invention is not limited to this. The base position (slide position converted from crank angle) may be detected instead of the base position command signal, and the detected base position detecting signal may be used. Furthermore, the relative position command signal for giving the vibration may be directly output.

[Configuration of Slide Motion Control Apparatus for Mechanical Press (Second Embodiment)]

Figure 7:
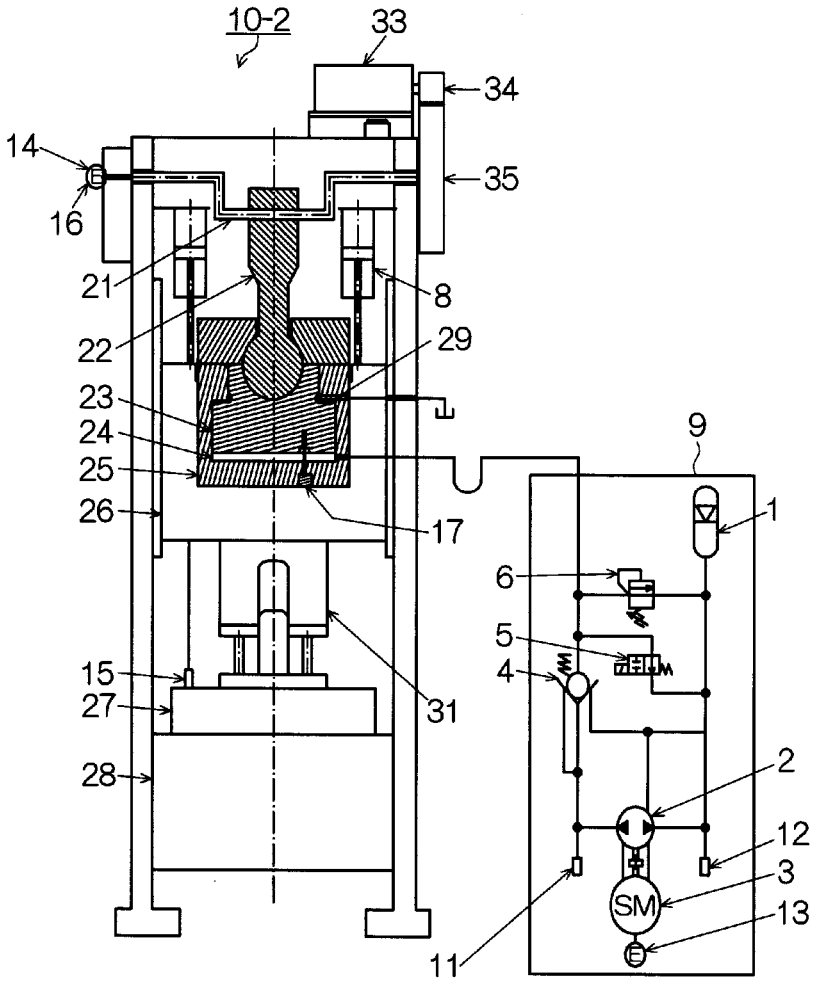
FIG. 7 is a configuration diagram showing a mechanical press to which a second embodiment of a slide motion control apparatus for the mechanical press pertaining to the present invention is applied, and a drive mechanism including a hydraulic circuit for the slide motion control apparatus.

FIG. 7 is a configuration diagram showing a mechanical press to which a second embodiment of a slide motion control apparatus for the mechanical press pertaining to the present invention is applied, and a drive mechanism including a hydraulic circuit for the slide motion control apparatus. Note that the same symbols are given to portions common to those of the first embodiment shown in FIG. 1, and that detailed description thereof will be omitted.

A mechanical press 10-2 of the second embodiment is different from the mechanical press 10-1 of the first embodiment mainly in a point where a slide relative position detector 17 is incorporated in the hydraulic cylinder mechanisms (the slide built-in cylinder 25 and the slide built-in piston 23). The slide relative position detector 17 can directly detect the con rod-based slide position (relative position), and can output the slide relative position detecting signal.

Figure 8:
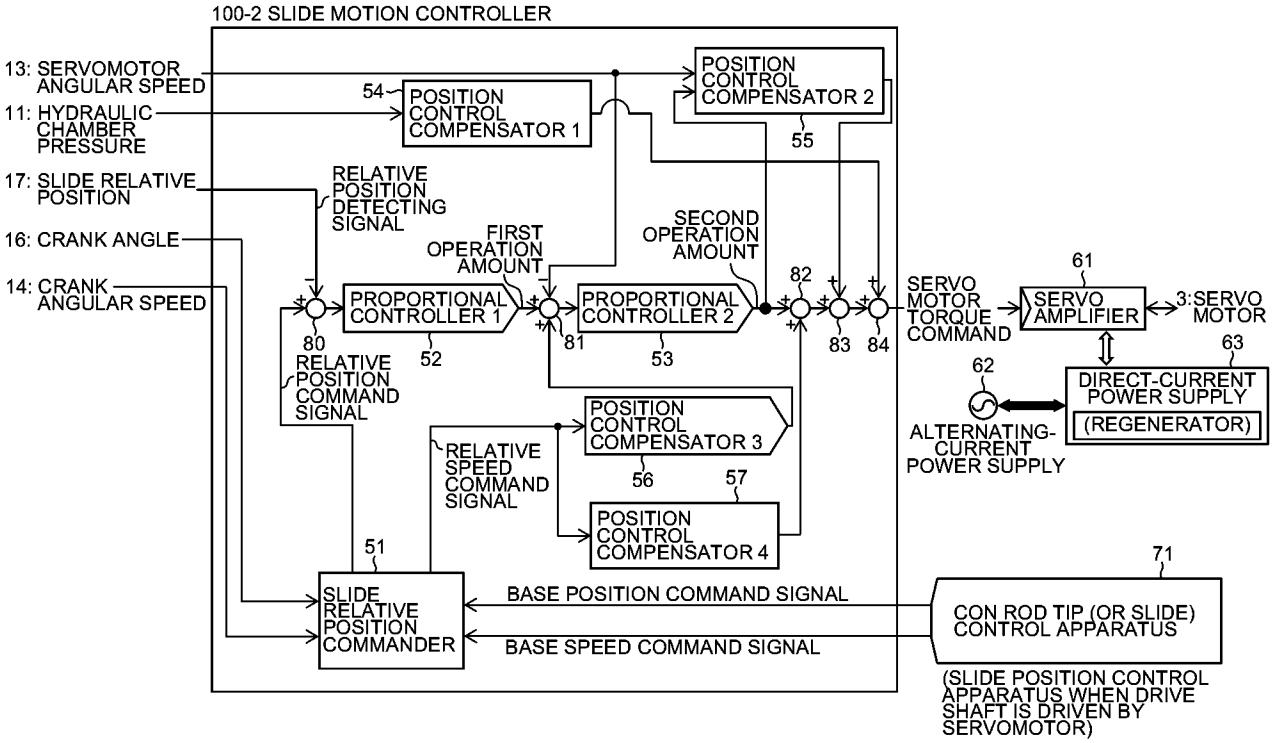
FIG. 8 is a block diagram showing the second embodiment of the control unit of the slide motion control apparatus for the mechanical press shown in FIG. 7.

FIG. 8 is a block diagram showing the second embodiment of the control unit of the slide motion control apparatus for the mechanical press, and corresponds to the mechanical press 10-2 shown in FIG. 7.

As shown in FIG. 8, the control unit (a slide motion controller) 100-2 of the second embodiment is different compared with the slide motion controller 100-1 shown in FIG. 2 in a point where the slide relative position detector 58 is omitted, and where the slide relative position detecting signal detected by the above-mentioned slide relative position detector 17 is directly input and added to the subtractor 80. Note that since the other configurations are common to the slide motion controller 100-1 shown in FIG. 2, detailed description thereof will be omitted.

[Configuration of Slide Motion Control Apparatus for Mechanical Press (Third Embodiment)]

Figure 9:
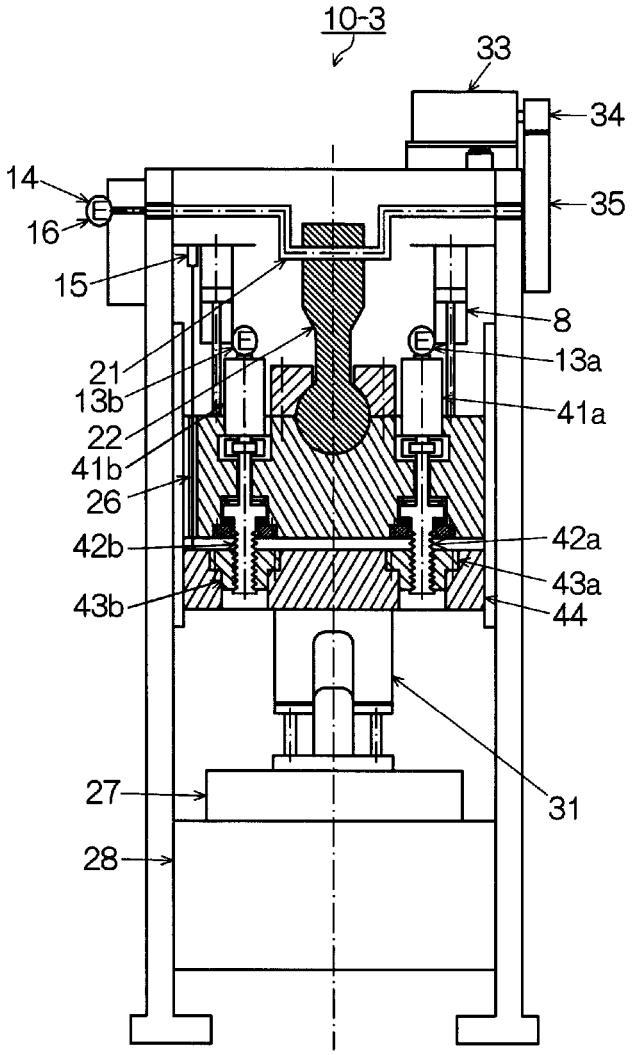
FIG. 9 is a configuration diagram showing a drive mechanism (screw mechanism) of a mechanical press to which a third embodiment of a slide motion control apparatus for the mechanical press pertaining to the present invention is applied and the slide motion control apparatus.

FIG. 9 is a configuration diagram showing a drive mechanism (screw mechanism) of a mechanical press to which a third embodiment of a slide motion control apparatus for the mechanical press pertaining to the present invention is applied and the slide motion control apparatus. Note that the same symbols are given to portions common to those of the first embodiment shown in FIG. 1, and that detailed description thereof will be omitted.

A mechanical press 10-3 of the third embodiment differs mainly in a point where whereas in the mechanical press 10-1 of the first embodiment, the cylinder-piston mechanisms (the slide built-in cylinder 25 and the slide built-in piston 23) and the hydraulic circuit 9 that are provided in the slide is applied as the drive mechanism that vertically drives the slide 26 with respect to the slide built-in piston 23 (driven body) driven by the con rod 22, in the mechanical press 10-3 of the third embodiment, a pair of screw mechanisms (screws 42*a* and 42*b*, and nuts 43*a* and 43*b*) driven by servomotors 41*a* and 41*b*, respectively, are applied.

Namely, in the mechanical press 10-3 of the third embodiment, a slide plate 44 (slide) is disposed so as to be vertically movable with respect to the slide 26 (driven body) driven by the con rod 22, the servomotors 41*a* and 41*b*, and the screws 42*a* and 42*b* driven by the servomotors 41*a* and 41*b* are disposed at the slide 26, and the nuts 43*a* and 43*b* which screw with the screws 42*a* and 42*b* are disposed at the slide plate 44.

Accordingly, when the screw mechanism with the above-described configuration is driven by the servomotors 41*a* and 41*b*, the slide plate 44 (slide) relatively vertically movable with respect to the slide 26 (driven body) can be moved.

Figure 10:
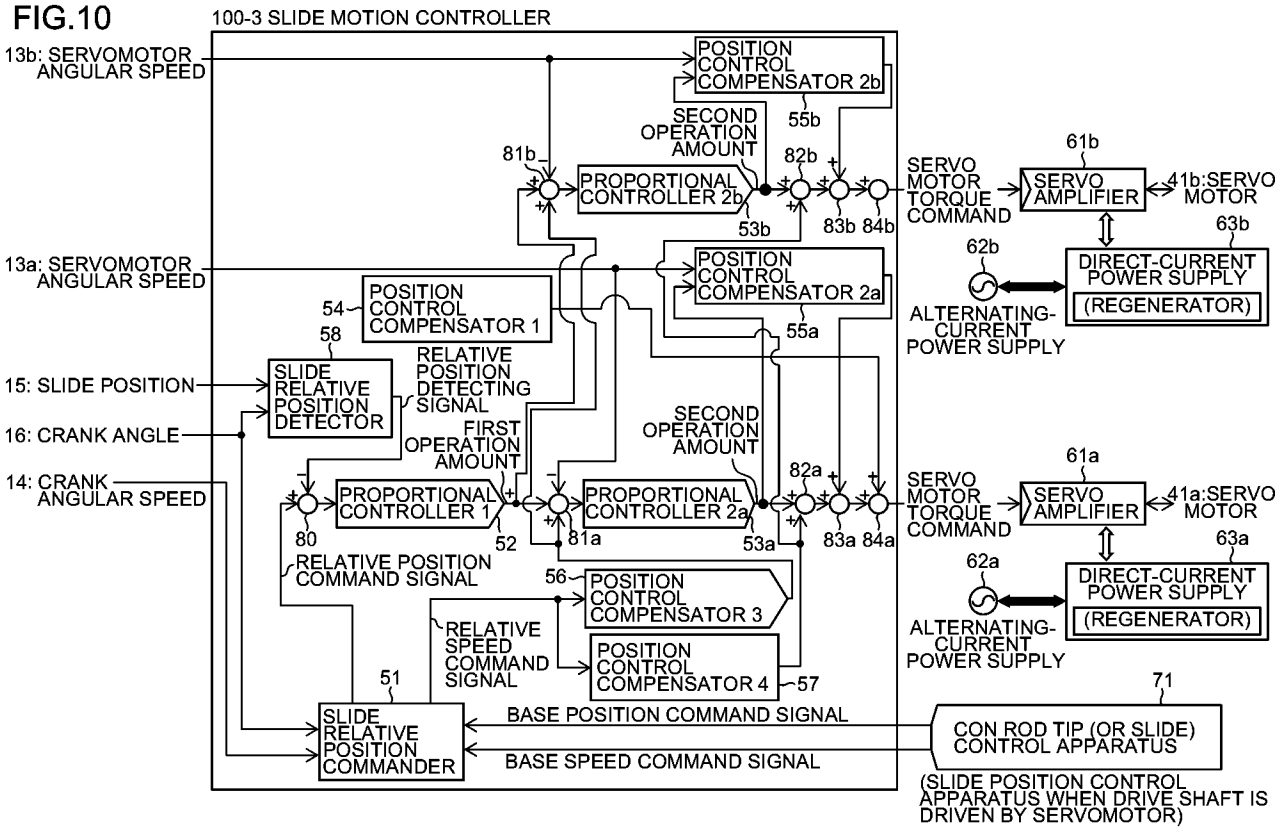
FIG. 10 is a block diagram showing the third embodiment of the control unit of the slide motion control apparatus for the mechanical press shown in FIG. 9.

FIG. 10 is a block diagram showing the third embodiment of the control unit of the slide motion control apparatus for the mechanical press, and corresponds to the mechanical press 10-3 shown in FIG. 9.

As shown in FIG. 10, the control unit (slide motion controller) 100-3 of the third embodiment is different compared with the slide motion controller 100-1 shown in FIG. 2 in a point where a servomotor torque command is calculated and output with respect to the servomotors 41*a* and 41*b* that drive the screw mechanisms (screws 42*a* and 42*b*), respectively.

Accordingly, as input signals to the slide motion controller 100-3, angular speed signals indicating angular speeds of the servomotors 3*a* and 3*b* are input from two angular speed detectors 13*a* and 13*b*, respectively. In addition, although a processing unit until the first operation amount signal output from the proportional controller 52 is generated is common, a processing unit of the subsequent signal generation branches into two systems, and the systems respectively use the angular speed signals detected by the angular speed detectors 13*a* and 13*b*.

According to the third embodiment, torques of the servomotors 41*a* and 41*b* that drive the screw mechanisms (screws 42*a* and 42*b*), respectively, can be individually controlled, and thereby a lowering speed in a horizontal direction of the slide plate 44 can be kept the same regardless of an eccentric load in the horizontal direction.

Note that the screw is rotated by the servomotor so as to relatively move the slide plate 44 in the third embodiment, but the present invention is not limited to this. The nut may be rotated to thereby relatively move the slide plate 44.

[Configuration of Slide Motion Control Apparatus for Mechanical Press (Fourth Embodiment)]

Figure 11:
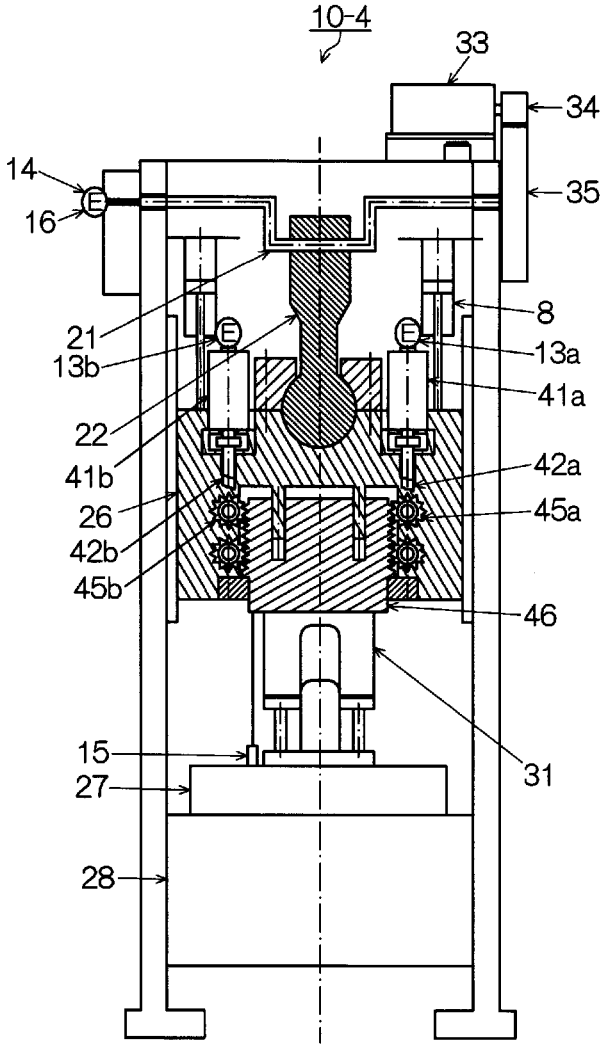
FIG. 11 is a configuration diagram showing a drive mechanism (rack and pinion mechanism) of a mechanical press to which a fourth embodiment of a slide motion control apparatus for the mechanical press pertaining to the present invention is applied, and the slide motion control apparatus.

FIG. 11 is a configuration diagram showing a drive mechanism (rack and pinion mechanism) of a mechanical press to which a fourth embodiment of a slide motion control apparatus for the mechanical press pertaining to the present invention is applied, and the slide motion control apparatus. Note that the same symbols are given to portions common to those of the third embodiment shown in FIG. 9, and that detailed description thereof will be omitted.

A mechanical press 10-4 of the fourth embodiment differs from that of the third embodiment mainly in a point where whereas the mechanical press 10-3 of the third embodiment relatively vertically moves the slide plate 44 (slide) by the screw mechanism with respect to the slide 26 (driven body) driven by the con rod 22, the mechanical press 10-4 of the fourth embodiment vertically moves a rack-equipped slide plate 46 by the rack and pinion mechanism.

Namely, in the mechanical press 10-4 of the fourth embodiment, the rack-equipped slide plate 46 (slide) is disposed so as to be vertically movable with respect to the slide 26 (driven body) driven by the con rod 22, the servomotors 41*a* and 41*b*, and pinions 45*a* and 45*b* to which a rotational drive force is transmitted through rotation transmitting shafts 42*a* and 42*b* from the servomotors 41*a* and 41*b* are disposed at the slide 26. A rack that meshes with the pinions 45*a* and 45*b* is provided at the rack-equipped slide plate 46.

Accordingly, when the rack and pinion mechanism with the above-described configuration is set as a drive by the servomotors 41*a* and 41*b*, the rack-equipped slide plate 46 (slide) relatively vertically movable with respect to the slide 26 (driven body) can be moved.

Note that since a configuration of the control unit for the slide motion control apparatus, the control unit that controls the servomotors 41*a* and 41*b* is common to that of the slide motion controller 100-3 of the third embodiment shown in FIG. 10, detailed description thereof will be omitted.

[Configuration of Slide Motion Control Apparatus for Mechanical Press (Fifth Embodiment)]

Figure 12:
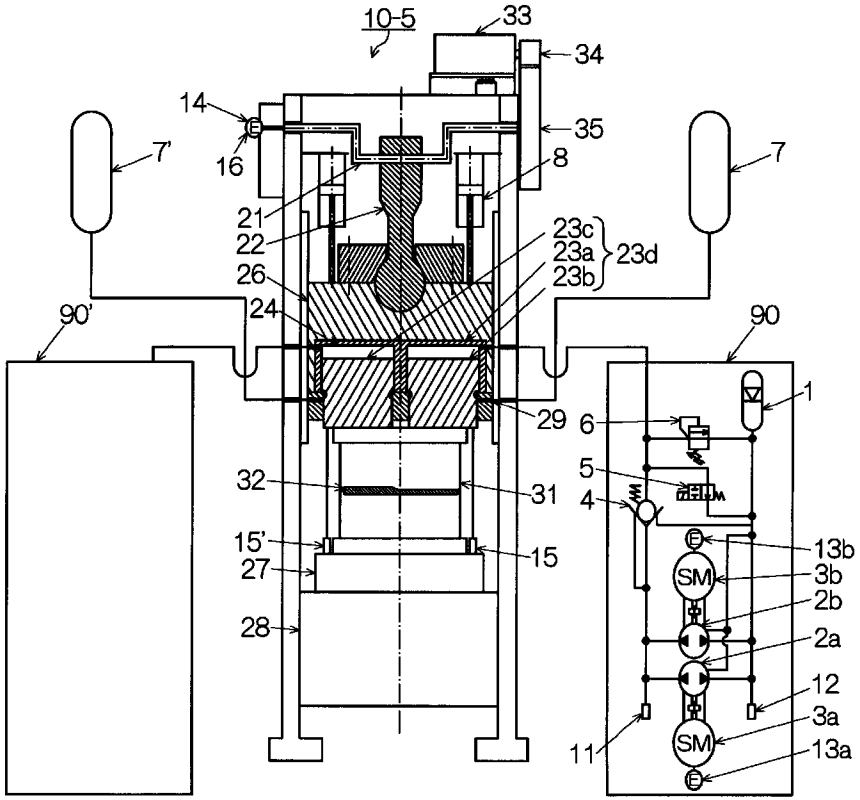
FIG. 12 is a configuration diagram showing a mechanical press to which a fifth embodiment of a slide motion control apparatus for the mechanical press pertaining to the present invention is applied, and a drive mechanism including a hydraulic circuit for and the slide motion control apparatus.

FIG. 12 is a configuration diagram showing a mechanical press to which a fifth embodiment of a slide motion control apparatus for the mechanical press pertaining to the present invention is applied, and a drive mechanism including a hydraulic circuit for and the slide motion control apparatus. Note that the same symbols are given to portions common to those of the first embodiment shown in FIG. 1, and that detailed description thereof will be omitted.

A mechanical press 10-5 of the fifth embodiment is different from the first embodiment in following points: two cylinder-piston mechanisms are mainly constituted by an inner slide 23*d* constituted by a slide built-in cylinder 23*a* and slide built-in pistons 23*b* and 23*c*; the slide 26 (driven body) is connected to the tip of the con rod 22; and the inner slide 23*d* is provided so as to be vertically movable with respect to the slide 26.

In addition, pressure oil can be supplied from hydraulic circuits 90 and 90', respectively, to two lowering-side hydraulic chambers of the two cylinder-piston mechanisms including the slide built-in cylinder 23*a* and the slide built-in pistons 23*b* and 23*c*, and the pressure oil supplied from the hydraulic circuits 90 and 90' become a power source for relatively lowering the slide built-in pistons 23*b* and 23*c* with respect to the con rod tip (slide built-in cylinder 23*a*). In addition, the power source that relatively raises the slide built-in pistons 23*b* and 23*c* with respect to the con rod tip is covered by a force generated by supplying an air pressure from air tanks 7 and 7' to a raising-side hydraulic chamber, or by thrust of the balance cylinder 8.

The hydraulic circuits 90 and 90' are configured substantially similarly to the hydraulic circuit 9 shown in FIG. 1, and differ mainly in a point where two sets of hydraulic pumps/motors and servomotors (a hydraulic pump/motor 2*a* and a servomotor 3*a*, and a hydraulic pump/motor 2*b* and a servomotor 3*b* (refer to FIGS. 13A and 13B)) are provided instead of the set of hydraulic pump/motor 2 and servomotor 3 of the first embodiment. Note that two hydraulic circuits 90 and 90' are similarly configured.

In addition, slide position detectors 15 and 15' that detect positions of the slide built-in pistons 23*b* and 23*c* (slides) are provided on a bolster 27 side of the mechanical press 10-5 of the fifth embodiment.

Figure 13A:
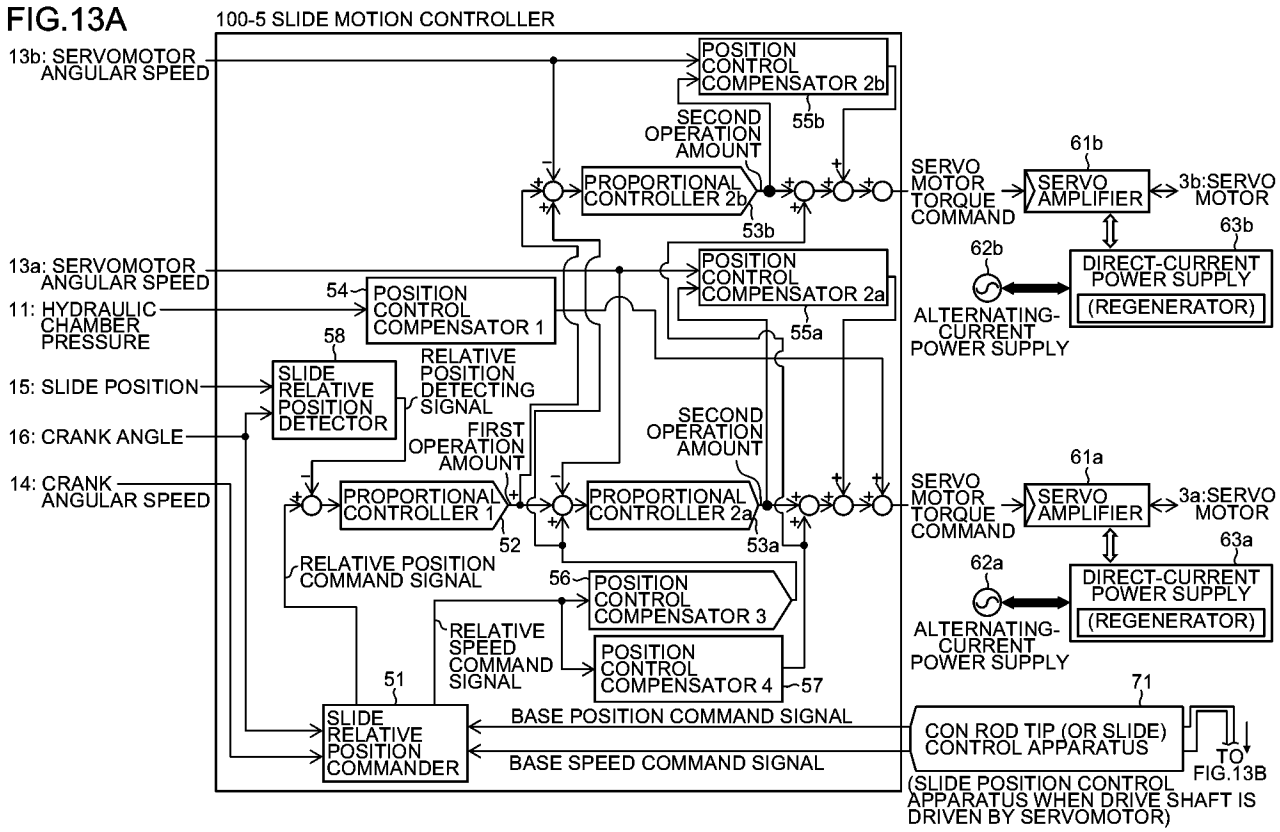
FIGS. 13A and 13B are block diagrams showing the embodiment of the control unit of the slide motion control apparatus for the mechanical press shown in FIG. 12.
Figure 13B:
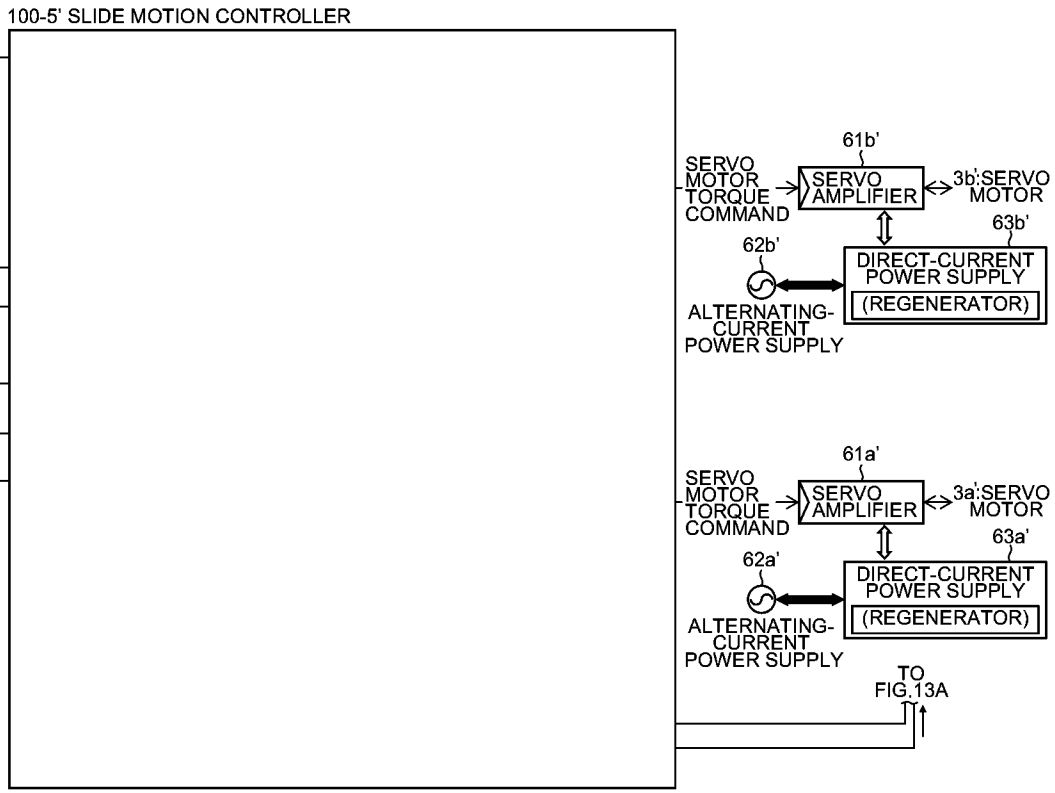

FIGS. 13A and 13B are block diagrams showing the embodiment of the control unit of the slide motion control apparatus for the mechanical press shown in FIG. 12.

As shown in FIGS. 13A and 13B, the control unit includes two slide motion controllers 100-5 and 100-5'. The slide motion controller 100-5 outputs torque commands to the two servomotors 3*a* and 3*b* of the hydraulic circuit 90, respectively. The slide motion controller 100-5' outputs torque commands to two servomotors 3*a'* and 3*b'* of the hydraulic circuit 90', respectively. Note that the slide motion controllers 100-5 and 100-5' are respectively configured similarly to the slide motion controller 100-3 shown in FIG. 10, but differ in a point where position detection signals of the slide built-in pistons 23*b* and 23*c* (slides) are input from the slide position detectors 15 and 15', respectively.

As a result, the slide motion controllers 100-5 and 100-5' control torque of the above-described servomotors 3*a* and 3*b*, and the servomotors 3*a'* and 3*b'*, respectively, and can control the slide built-in pistons 23*b* and 23*c* (slides) so that they locate at commanded relative positions with respect to the slide 26 (driven body), respectively.

Note that the hydraulic circuit is not limited to have two sets of hydraulic pumps/motors and servomotors, but that three or more sets of hydraulic pumps/motors and servomotors may be used.

[Description of Action of Slide Motion Control Apparatus for Mechanical Press of Fifth Embodiment]

<Problem of Conventional Technology>

In a case where press molding is performed using a so-called tailored blank material in which a plurality of plates (two plates in the example) with different plate thicknesses and materials are arranged (from side to side in the example), and joined by welding etc., to be one material, when a conventional mechanical press is used, a strength variation occurs partially (each of the right and left in the example) in action of a molding load by a rigidity difference and a hardness difference due to a difference in plate thickness or a difference in material. As a result, an eccentric load acts on the mechanical press.

The above and an effect obtained by the present invention will be described using a simple schematic view shown in FIG. 14.

Figure 14B:
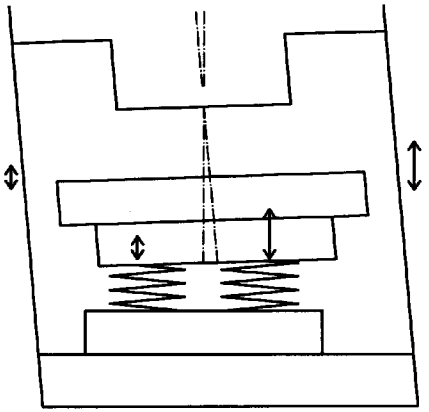
FIGS. 14A and 14B are illustrations used to describe a problem when an eccentric load acts in a conventional mechanical press.
Figure 14A:
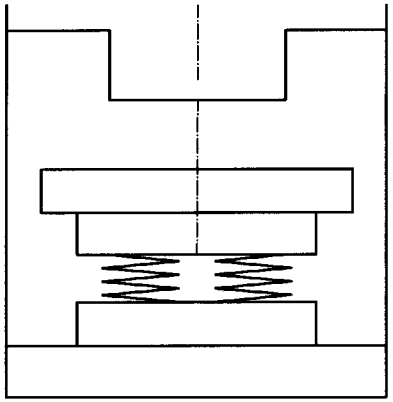

When press-molding of a material with different rigidity in the right and left is performed as shown in FIG. 14A, a larger molding load acts on the right side where rigidity is stronger as shown in FIG. 14B. In so doing, the right side of a frame of the press machine extends more compared with the left side thereof due to the eccentric load in right and left.

If an amount of die height (corresponding to a distance between the upper and lower dies) is adjusted so that a press load needed for molding (in order to accurately transfer a material to the die) acts on a left-side material, a larger load acts on the right side, which easily causes a situation unsuitable for molding of the right-side material. In addition, in so doing, an eccentric load exceeding the strength easily acts on the press machine. These are the problems that hinder moldability, and also hinder press machine performance.

In order to solve the above problems, in the fifth embodiment, a plurality of (two in the example) inner slides (slide built-in pistons) that can operate respectively independently are provided (from side to side in the example) in the slide.

Figure 15C:
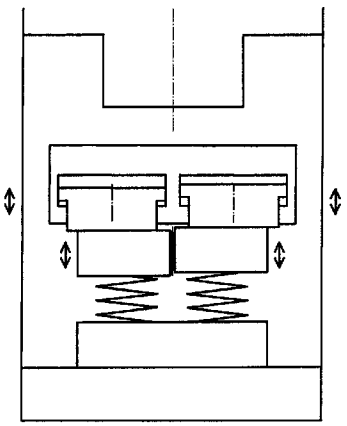
FIGS. 15A to 15C are illustrations showing how an eccentric load does not act on the mechanical press in the slide motion control apparatus for the mechanical press of the fifth embodiment.
Figure 15B:
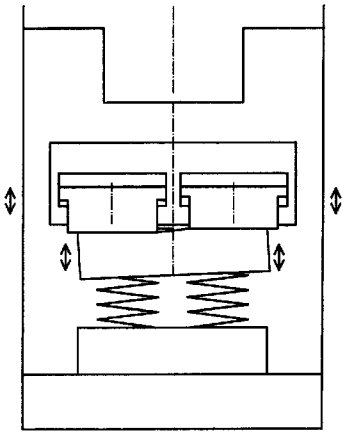
Figure 15A:
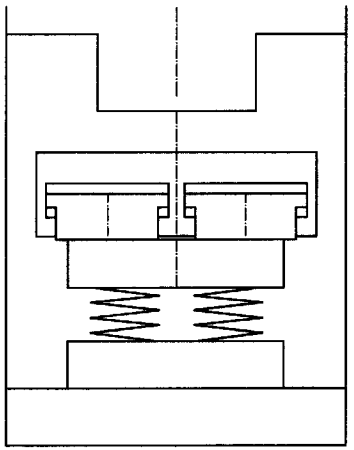

As shown in FIG. 15A, two inner slides that operate respectively independently are provided in the slide, positions of the right-and-left inner slides are adjusted to suit each of the right-and-left material rigidity according to a molding process. FIG. 15B shows a state where right-and-left bottom dead center positions are controlled (so as to be a left inner slide position<(is lower than) a right inner slide position) so that the right-and-left molding loads become uniform according to the right-and-left material rigidity. In doing so, the eccentric load does not act on the press machine. However, inclination in the right and left occurs in the die. Consequently, if a structure is employed where the right and left sides of the die can operate respectively independently in the vertical direction in accordance with the present invention as shown in FIG. 15C, a problem of inclination of the die is also solved.

Figure 16B:
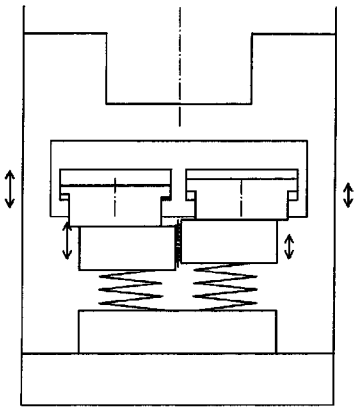
FIGS. 16A and 16B are a graph and an illustration showing an example where inner slide operations for right and left are respectively controlled to generate a molding load according to molding processes for right and left while giving priority to moldability.
Figure 16A:
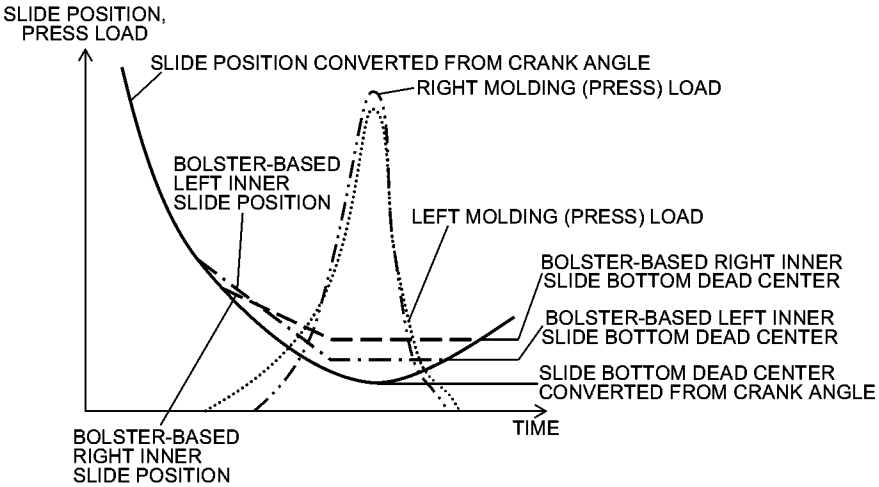

Furthermore, putting priority on moldability that is a main object, in order to generate the molding loads according to each of the right-and-left molding processes, each of the right-and-left inner slide operation (position in the molding process) is controlled as a wave form indicated with a broken line and an alternate long and short dash line of FIG. 16A. In the bottom dead center, as shown in FIG. 16B, the bottom dead center position differs and the molding load differs in each of the right and left sides. The difference of the loads is a requisite minimum for molding, and promotes moldability. In addition, as a result, a case increases where the difference can fall in a permissible unbalanced load range from a viewpoint of strength of the press machine, and performance of the press machine cannot easily hindered. As described above, the present invention is applied to a press machine, and thereby an advantage to improve press moldability of a tailored blank material can be obtained without hindering performance of the press machine.

[Others]

The slide motion control apparatus pertaining to the present invention can be applied not limitedly to a crank press as a mechanical press, but also can be applied to a link press driven by a link mechanism.

In addition, the present invention can be applied also to a mechanical press that drives one or more driven bodies by a plurality of con rods.

Furthermore, the present invention is not limited to the above-mentioned embodiments, and it is needless to say that various modifications can be made without departing from the spirit of the present invention.

What is claimed is:

1. A slide motion control apparatus for a mechanical press comprising:

a slide which is disposed so as to be relatively vertically movable with respect to a driven body to which a drive force is transmitted through a con rod of the mechanical press;

a relative position command unit that outputs a relative position command indicating a relative position of the slide with respect to the driven body;

a relative position detecting unit that detects a relative position of the slide with respect to the driven body, and outputs a relative position detecting signal indicating the detected relative position;

a servomotor;

a drive mechanism that relatively moves the slide with respect to the driven body by a drive force of the servomotor; and a control unit configured to control the servomotor based on a relative position command signal output from the relative position command unit, and the relative position detecting signal output from the relative position detecting unit, wherein a plurality of relative position detecting units, a plurality of servomotors, and a plurality of drive mechanisms are respectively provided, the plurality of relative position detecting units respectively detect a plurality of relative positions of the slide with respect to the driven body and respectively output relative position detecting signals indicating the detected relative positions, the plurality of drive mechanisms relatively move the slide with respect to the driven body by drive forces of the plurality of servomotors, the control unit is configured to respectively control the plurality of servomotors based on the relative position command signal output from the relative position command unit, and the plurality of relative position detecting signals output from the plurality of relative position detecting units, the slide includes a plurality of inner slides which are disposed so as to be respectively vertically movable with respect to the driven body, the plurality of relative position detecting units respectively detect relative positions of the plurality of inner slides with respect to the driven body, the plurality of drive mechanisms relatively move the plurality of inner slides respectively and independently, the relative position command unit respectively outputs relative position commands indicating the relative positions of the plurality of inner slides with respect to the driven body, and the control unit is configured to control the plurality of servomotors, respectively, based on the plurality of relative position command signals which correspond to the plurality of inner slides and are output from the relative position command unit, and the plurality of relative position detecting signals output from the plurality of relative position detecting units.

* * * * *